US005663034A

United States Patent [19]

Rüger

[11] Patent Number: 5,663,034

[45] Date of Patent: Sep. 2, 1997

[54] SILVER HALIDE RECORDING MATERIAL FOR MAKING NEGATIVE IMAGES HAVING ULTRAHIGH CONTRAST

[75] Inventor: Reinhold Rüger, Rodermark, Germany

[73] Assignee: E. I. Du Pont de Nemours and Company, Wilmington, Del.

[21] Appl. No.: 632,859

[22] Filed: Apr. 16, 1996

[30] Foreign Application Priority Data

Apr. 28, 1995 [DE] Germany ..... 195 15 619.6

[51] Int. Cl.[6] ..... G03C 1/295; G03C 1/10

[52] U.S. Cl. ..... 430/264; 430/599; 430/600; 430/602; 430/603

[58] Field of Search ..... 430/264, 599, 430/600, 602, 603

[56] References Cited

U.S. PATENT DOCUMENTS

| | | | |
|---|---|---|---|
| 4,914,003 | 4/1990 | Yagihara et al. | 430/264 |
| 4,975,354 | 12/1990 | Machonkin et al. | 430/264 |

FOREIGN PATENT DOCUMENTS

| | | | |
|---|---|---|---|
| 0 032 456 B1 | 2/1983 | European Pat. Off. | G03C 5/26 |
| 0 203 521 A2 | 12/1986 | European Pat. Off. | G03C 5/30 |
| 0 422 677 A1 | 4/1991 | European Pat. Off. | G03C 5/305 |
| 0 473 342 A1 | 3/1992 | European Pat. Off. | G03C 1/10 |
| 0 539 998 A1 | 5/1993 | European Pat. Off. | G03C 1/06 |
| 43 10 327 A1 | 10/1994 | Germany | G03C 5/29 |

*Primary Examiner*—Richard L. Schilling

[57] ABSTRACT

Silver halide recording material for making negative images having ultrahigh contrast.

Known silver halide recording materials for making negative images having ultrahigh contrast contain hydrazine compounds and contrast enhancing compounds (so-called boosters). The invention involves a material having a new class of such a booster, containing in its molecule at least one nitrile group and a tertiary amino group. The invention also includes a process for making black-and-white negative images having ultrahigh contrast by using the invention's materials. The invention is particularly useful in the pre-press stage for printing.

11 Claims, No Drawings

SILVER HALIDE RECORDING MATERIAL FOR MAKING NEGATIVE IMAGES HAVING ULTRAHIGH CONTRAST

BACKGROUND OF THE INVENTION

1. Field of the Invention

The invention involves a photographic, silver halide, recording material for making black and white negative images having ultrahigh contrast and a process for making a black and white negative image by using such a material.

2. Description of the Related Art

In photomechanical reproduction, continuous tone images must frequently be converted into halftone images. Used for this purpose are silver halide materials that are developed by special processes to ultrahigh contrast, that is, to a maximum slope of the density curve of more than 10. Known examples are litho-graphic processes with sulfite-poor hydroquinone developers containing formaldehyde. Development in the presence of hydrazine compounds has been especially important recently.

In these processes, certain amino compounds are frequently used to increase contrast. Thus, EP-00 32 456-B1 claims a process in which a recording material is processed in the presence of a hydrazine compound with a hydroquinone-3-pyrazolidinone developer containing a contrast-enhancing quantity of an amino compound.

Developers containing a contrast-enhancing quantity of an amino compound have disadvantages. The required concentration of the amino compound is considerable and often approaches the limits of solubility. If temperature increase or concentration changes slightly due to water dilution during use, the solubility limits can be easily exceeded and the amino compound precipitates. This can lead to irregular development and to contamination of the recording material and the developing machines. Because of their volatility, the precipitated amino compounds can also reach remote parts of the developing machines, causing contamination and corrosion.

The use of developers containing amino compounds is also accompanied by a very unpleasant odor, due to the required high concentration and the volatility of these compounds.

Because the amino compounds have a limited solubility, it is difficult to formulate the conventional developer concentrates for commercial use. EP-A-02 03 521 does indeed disclose the use of salts of certain sulfonic or carboxylic acids as solubilizers. However, the other cited problems are not affected by such additives.

The known developers usually have a pH above 11. Therefore, they are not adequately stable in use and highly corrosive to parts of developing machines. German OS DE-A-43 10 327 describes a process for making negative images having ultrahigh contrast. In this process, the silver halide recording material is developed in the presence of compounds having at least one quaternary nitrogen atom and at least one tertiary amine function in the molecule.

EP-04 73 342-A1 describes a photographic silver halide material that can be developed to ultrahigh contrast in a developer having a pH<11. The photosensitive coating of this material contains a hydrazine compound of a certain formula and an amino or quaternary onium compound and is adjusted to a pH of at least 5.9.

U.S. Pat. No. 4,975,354 discloses incorporating in the silver halide materials, in addition to hydrazine compounds, certain secondary or tertiary amino compounds, also containing at least three oxyethylene units in their molecule as contrast boosters.

EP 04 22 677 describes the use of tertiary amino compounds having at least three oxyethylene units in the molecule as development accelerators in developer solutions, that also act in the presence of hydrazine compounds.

EP 05 39 998 claims silver halide materials containing, in addition to hydrazine compounds, thioether compounds having tertiary amino groups.

These contrast-enhancing additives can yield satisfactory images only when used in relatively large quantities. This has adverse effects on the properties of the recording material, for example, storage stability, wet pressure sensitivity, and drying behavior.

SUMMARY OF THE INVENTION

The problem involved in the invention is to make a silver halide recording material suitable for making negative images having ultrahigh contrast in a short processing time with a stable, odor-free, non-corrosive developer and without the above-cited disadvantages. The problem also involves developing a process for making black and white negative images having ultrahigh contrast.

These problems are solved by a silver halide recording material having at least one photosensitive layer on at least one side of a support, optionally other layers on the same side of the support, and containing at least one hydrazine compound in the photosensitive layer or in a layer located in a reactive relationship with the photosensitive layer, characterized in that it contains in this layer or in another layer located in a reactive relationship with it at least one contrast-enhancing compound having in its molecule at least one tertiary amino group and at least one nitrile group.

It was found, surprisingly, that these contrast-enhancing compounds containing in their molecule at least one nitrile group and at least one tertiary amino group, and incorporated together with hydrazine compounds into silver halide recording materials enable the preparation of images having ultra high contrast at a relatively low developer pH and in a short development time.

The tertiary amino group has a nitrogen atom linked by single bonds to two organic radicals and through a divalent linking group to the nitrile group.

These problems are also solved by a process in which the silver halide recording material containing the contrast-enhancing compounds is subjected to imagewise exposing and developing in a developer having a pH between 9 and 11.

DETAILED DESCRIPTION OF THE INVENTION

In a preferred embodiment of the invention, the contrast-enhancing compound falls under one of the following General Formulas (A), (B), or (C):

$$RR^1N—X—(CN)_n \quad (A)$$

$$NC—X—NR^2—B—NR^2—X—CN \quad (B)$$

$$RR^1N—X—N(CH_2CN)_2 \quad (C)$$

Radicals R and $R^1$ can be identical or different and each a straight-chain or branched alkyl group having 1 to 6 carbon atoms, for example, methyl, ethyl, n-propyl, isopropyl, n-butyl, isobutyl, and n-hexyl. They can also form a heterocyclic ring having 5 to 12 members by including the nitrogen atom and optionally another nitrogen atom, an oxygen atom, or a carbonyl group, for example, a piperidine, pyrrolidine, pyrroline, oxazolidine, imidazoline, morpholine, pyrazane, azepine, oxazepine, or azacyclodecane ring. Each of the groups R and $R^1$ can also be a benzyl group. The groups R and $R^1$ and also the heterocyclic rings corresponding to these groups can be substituted further, preferably with hydroxyl, alkoxy, alkylthio, or alkylamino groups, the alkyl moiety having 1 to 6 carbon atoms. Examples of such substituents are methoxy, ethoxy, propoxy, butoxy, ethylamino, dimethylamino, and butylthio groups.

R or $R^1$ can also have their free ends joined to the linking group X to form a ring that includes the nitrogen atom of the tertiary amino group. Such a ring can be, for example, a piperidine ring or a morpholine ring.

The divalent linking groups X and B are preferably straight chain, branched, or cyclic alkylene groups having 1 to 10 carbon atoms, phenylene or aralkylene groups having 7 to 20 carbon atoms, or divalent chains of 1 to 20 methylene groups, which can also incorporate oxygen, sulfur, amino groups, alkene groups, alkyne groups, or polyoxyalkylene groups, especially polyoxyethylene, or polyoxypropylene groups having 1 to 50 oxyalkyl units. An ethylene group or a propylene group is especially preferred. These groups can also be substituted further, for example, with alkyl, hydroxyl, and other tertiary amino groups.

The linking group X can also be trivalent and thus link the tertiary amino group with two nitrile groups. The groups cited in the preceding paragraph are suitable if they contain another free valence instead of a hydrogen atom. Examples are:

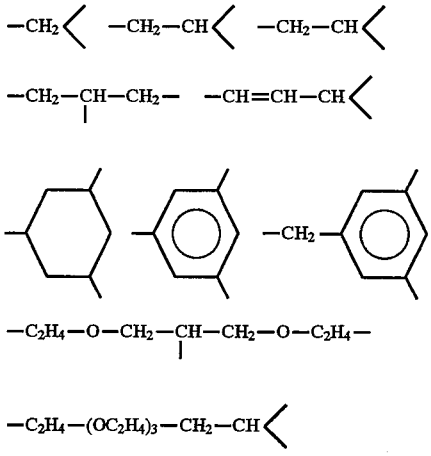

The radical $R^2$ in the General Formula (B) is a saturated or unsaturated alkyl group, preferably having 1 to 12 carbon atoms, an aryl group, preferably having 6 to 14 carbon atoms, or an aralkyl group, preferably having 7 to 15 carbon atoms. These groups can in turn be substituted, for example, with hydroxyl, amino, alkylamino, and alkoxy groups, the alkyl preferably having 1 to 6 carbon atoms. If an alkyl group is involved, it can also be linked through its end away from the nitrogen to a carbon atom of the Group B to form a ring. Such a ring can be, for example, a piperidine, pyrrolidine, or hexahydroazepine ring. The two radicals $R^2$ can also form together with B or with parts of B and with the two nitrogen atoms one or two saturated rings, preferably having 5 or 6 members, for example, pyrrolidine or piperidine rings.

In the General Formula (A), n is either 1 or 2.

Since the contrast-increasing compounds according to the invention contain at least one tertiary amino group in their molecule, they can be prepared, handled and utilized in the form of a free amine and also in the form of a salt, i.e., an adduct of an acid to the free amine. A preferred acid is hydrochloric acid.

The invention's contrast-enhancing compounds can be prepared from easily available and favorably priced starting ingredients. The expert can find suitable processes in the standard references for preparative organic chemistry, for example, the introduction of a cyanomethyl group by means of chloroacetonitrile, the alkylation of cyanides (Houben-Weyl, "Methods of Organic Chemistry", 4th edition, volume 8 (1952) pages 290 ff) and the dehydration of carboxylic acid amides (ibid., pages 330 ff.) Other synthesis possibilities are alkylating the anion of a suitable CH acidic compound (i.e., a compound having a CH group capable of forming a carbanion) such as malonic acid dinitrile, with aminohalogen alkanes and the reaction of ketones with cyanides to cyanohydrins. Several of the invention's compounds are also available commercially and economically.

Examples of the invention's contrast-enhancing compounds are:

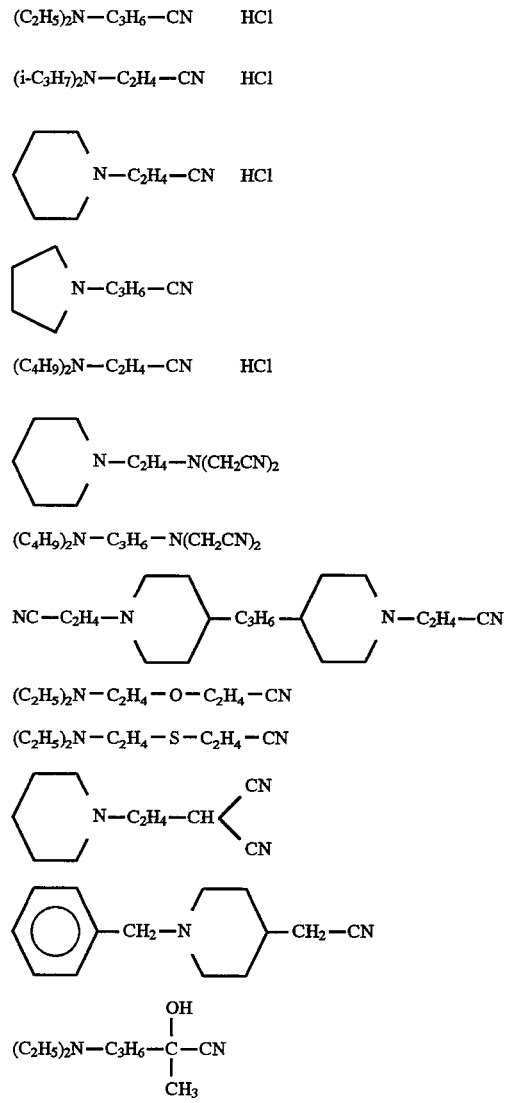

The invention's recording material contains a hydrazine compound. This hydrazine compound can be incorporated in a known manner in either one or more layers of the recording material. These can be layers containing photosensitive silver halide as well as layers being in reactive relationships to the preceding, that is, they are placed so that ingredients can diffuse from one layer into another, if a concentration gradient is maintained by reactions.

Suitable hydrazine compounds are described, for example, in Research Disclosure 235 010 (November, 1983), DE-27 25 743-A1, EP-00 32 456-B1, EP-01 26 000-A2, EP-01 38 200-A2, EP-02 03 521-A2, EP-02 17 310-A2, EP-02 53 665-A2, EP-03 24 391-A2, EP-03 24 426-A2, EP-03 26 443-A2, EP-03 56 898-A2, EP-04 73 342-A2, EP-05 01 546-A1, EP-04 81 565-A, EP-05 98 315-A1, EP-04 44 506.

Preferred hydrazine compounds have the General Formula (H):

B—Phenyl—NHNH—L—G (H).

B is a ballast group, G is an activating group, and L is one of the groups —CO— and —CO—CO—. "Phenyl" is a benzene ring to which B and the hydrazine group are linked, preferably in the para position.

Preferred ballast groups are those that are not electrophilic, for example, straight or branched alkyl groups, (for example, methyl, ethyl, n-propyl, isopropyl, n-butyl, isobutyl, n-hexyl, n-octyl, t-octyl, n-decyl, n-dodecyl, and similar groups), alkoxy groups containing one of the preceding alkyl groups, and acylamino groups, such as acetylamino, propanoylamino, butanoylamino, octanoylamino, benzoylamino, alkyl and arylsulfonamido, and similar groups.

The cited groups themselves can be substituted with conventional photographic ballast groups, as are known in incorporated diffusion-fast couplers and other immobilized photographic additives. Such ballast groups contain typically at least 8 carbon atoms and can be selected from relatively inert aliphatic or aromatic groups, for example, alkyl, alkoxy, phenyl, alkylphenyl, phenoxy, alkylphenoxy, arylacyl, arylamido, alkyl-pyridinium-1-ylamido, and similar groups.

The alkyl and alkoxy groups include any ballast groups, preferably having 1 to 20 carbon atoms and the acylamino groups, preferably having 2 to 21 carbon atoms. However, these groups can contain up to 30 or more carbon atoms. Methoxyphenyl, tolyl, ballasted butyramidophenyl, butylsulfonamido, and toluylsulfonamido groups are preferred.

The preferred hydrazine compounds include those having ballast groups containing a group that promotes adsorption. Such groups promote the adsorption of the molecule on the surface of the silver halide crystal and are known as such. They contain typically at least one sulfur or nitrogen atom that can form a silver complex or otherwise has an affinity for the silver halide surface. Preferred examples are thiourea, thiuronium, heterocyclic thioamide, and triazole groups.

G is preferably hydrogen, optionally substituted alkyl (for example, methyl, hydroxymethyl, monofluoromethyl, pyridinomethyl, phenoxymethyl, and alkoxymethyl, such as methoxymethyl), optionally substituted aralkyl (for example, benzyl, o-hydroxybenzyl), and optionally substituted aryl (for example, phenyl, 3,5-dichlorophenyl, o-methane-sulfonamidophenyl, 4-methanesulfonyl methyl, and 2-hydroxymethylphenyl). Alkyl groups having electrophilic substituents, for example, cationic groups having a quaternary nitrogen atom, such as pyridinium and imidazolium, are especially preferred.

G can also be further substituted, for example, with alkyl, aralkyl, alkenyl, alkynyl, alkoxy, aryl, substituted amino, ureido, urethane, aryloxy, sulfamoyl, carbamoyl, alkylthio, arylthio, alkylsulfonyl, arylsulfonyl, alkylsulfinyl, arylsulfinyl, hydroxyl, halogen, cyano, sulfo, aryloxycarbonyl, acyl, alkoxycarbonyl, acyloxy, carbamide, sulfonamide, carboxyl, phosphamide, diacylamino, and imide groups.

G can also be selected so that the L-G part of the molecule is separated by ring formation, as described, for example, in EP-B-02 53 665.

Examples of suitable hydrazine compounds are:

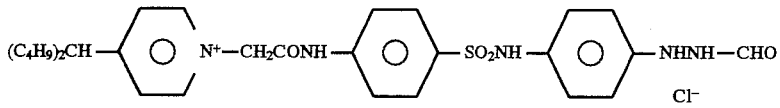

H-1

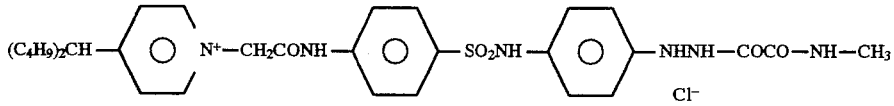

H-2

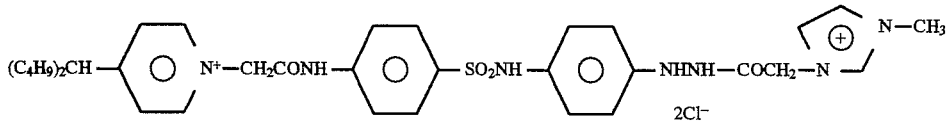

H-3

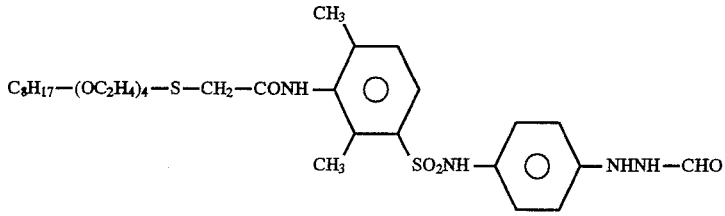

H-4

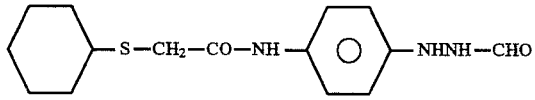

H-5

-continued
H-6
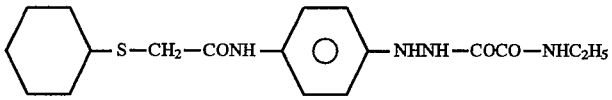
H-7
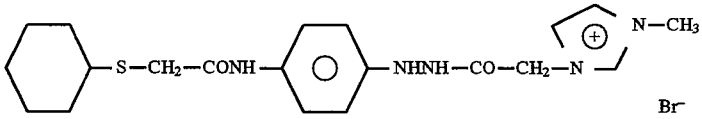
H-8
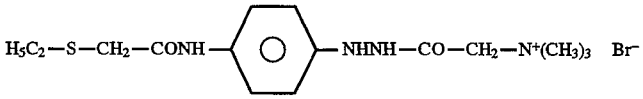
H-9
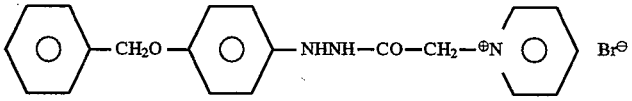
H-10
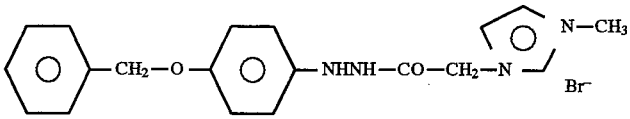
H-11
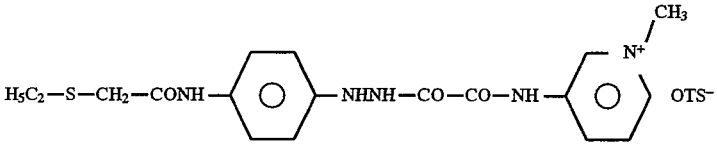
H-12
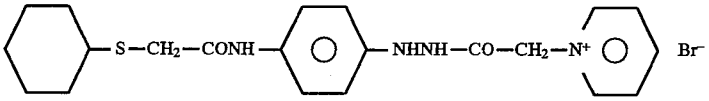
H-13
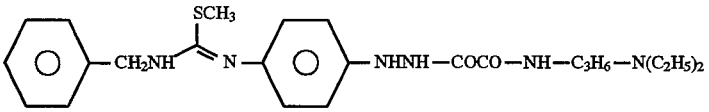
H-14
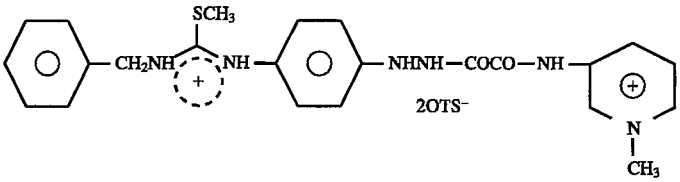
H-15
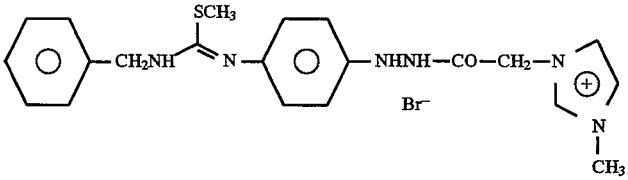
H-16
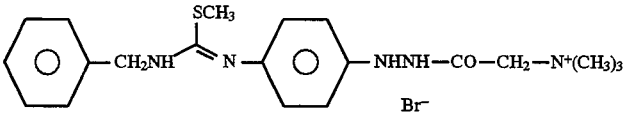
H-17
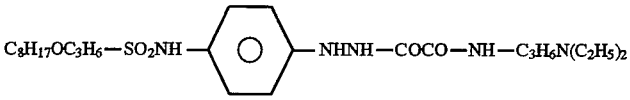

-continued

H-18

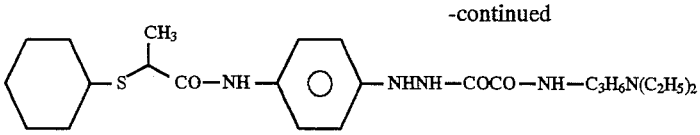

H-19

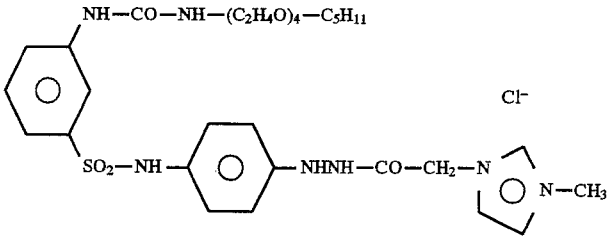

H-20

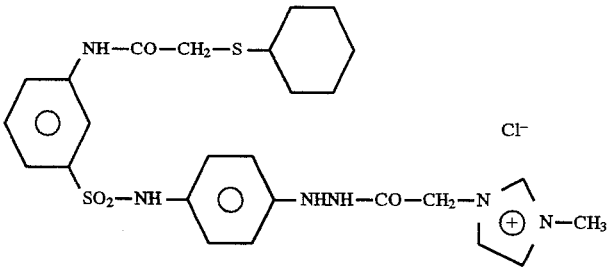

H-21

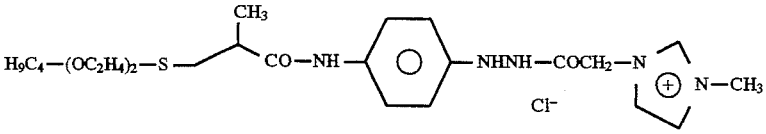

$OTS^-$ is the anion of o-toluenesulfonic acid.

The photosensitive silver halides of the invention's recording materials are silver chloride, silver bromide, silver chlorobromide, silver bromoiodide, or silver chlorobromoiodide. These can be monodisperse or polydisperse, can have a uniform composition, but can also be grains having a core-shell structure, and can also be mixtures of grains of different composition and size distribution. They are prepared with the use of a hydrophilic colloidal binder, preferably gelatin. The silver halide grains can be spherical, polyhedral, or tabular. The expert knows methods for making suitable photosensitive silver halide emulsions, such as compiled, for example, in Research Disclosure 365 044, Section I to IV (September, 1994).

The preferred silver halide emulsions for the invention's recording materials are prepared by controlled double jet precipitation and have a cubic grain shape. Emulsions having at least 80 percent by weight of cubic silver halide grains are advantageous. Especially preferred are monodisperse emulsions, that is, those having a coefficient of variation (quotient of standard deviation and average value) in grain size of less than 0.30. Grain size is the edge length of a cube having the same volume as the actual grain.

The grain volume of the silver halide grains in the emulsions depends on the required sensitivity and can correspond, for example, to cubic grains of 0.1 to 0.7 μm edge length. A preferred range is between 0.15 and 0.30 μm. Noble metal salts, especially salts of rhodium or iridium, can be present during emulsion preparation in the usual quantities to regulate photographic properties.

The preferred emulsions are sensitized chemically. Suitable methods are sulfur, reduction, and noble metal sensitization, which can also be used in combinations. An example of the latter uses gold or iridium compounds. Sensitization is conducted preferably in the presence of salts of organic thiosulfonic acids, such as p-toluene thiosulfonic acid.

The emulsions can be sensitized spectrally with the usual sensitizing dyes, such as described, for example, in Research Disclosure 365 044, Section V (September, 1994).

The emulsions can also contain the usual antifoggants. Optionally substituted benzotriazole, 5-nitroindazole, and 1-phenyl-5-mercaptotetrazole are preferred. These agents can be added at any time during emulsion preparation or can be incorporated in an auxiliary layer of the photographic material. To improve photographic properties, an iodide can be added to the emulsion before or after chemical ripening, preferably about 0.5 to 5 mmoles of an alkali iodide per mole of silver.

The emulsions can also contain known polymer dispersions, which, for example, improve the dimensional stability of the photographic material. These are usually latexes of hydrophobic polymers in an aqueous matrix. Examples of suitable polymer dispersions are given in Research Disclosure 176 043, Section IX B (December, 1978). Polymers of acrylic and methacrylic acid esters are preferred, the $C_1$ to $C_6$ esters being especially preferred. The preferred particle size of these polymer latexes is between 20 and 100 nm.

The photosensitive layers of the photographic materials can be hardened by the addition of a hardener. Examples of hardeners are named in Research Disclosure 365 044, Section II B (September, 1994). This hardener can be added to the emulsion or to an auxiliary layer, for example, an outer protective layer. Examples of suitable hardeners are aldehydes, such as formaldehyde or glutaraldehyde, vinyl sulfones, s-triazines, aziridines, carbodiimides, carbamoyl pyridinium compounds, monofunctional and bifunctional carbamoyl imidazolium compounds. A preferred hardener is hydroxydichlorotriazine.

The photographic material can contain other additives that are known and customary for producing certain properties. Such additives are listed, for example, in Research Disclosure 365 044 (September, 1994), Section VI (brighteners), IX A (coating aids), IX B (plasticizers and slip agents), and IX D (matte agents).

The gelatin content of the emulsions is generally between 30 and 150 g per mole of silver. The range between 40 and 100 g per mole of silver is preferred.

The invention also includes a process for making black and white, negative photographic images. The process is characterized by exposing imagewise a previously described, photosensitive, recording material, developing it in an aqueous developing solution, fixing it as usual, washing, and drying. The invention's developer solutions contain preferably a dihydroxybenzene developer, for example hydroquinone pyrocatechol, methyl hydroquinone, or chlorohydroquinone, and an antioxidant, preferably an alkali sulfite in a concentration above 0.3 mole per liter. Solutions having pH values from 9 to a maximum of 11 are especially preferred. Such developer solutions are stable in use and yield images largely free of fog. Also useful are developer solutions having a developer component of the ascorbic acid type, for example, L-ascorbic acid, D-ascorbic acid, L-erythroascorbic acid, 6-desoxy-L-ascorbic acid, imino-L-erythroascorbic acid, or sugar derivatives of these acids. Also suitable are developer solutions containing developers of the dihydroxybenzene type and of the ascorbic acid type.

Preferred developer solutions contain known superadditive-acting developer aids, for example, N-methyl-p-aminophenol, 1-phenylpyrazolidinone-3, or derivatives of these compounds.

Developers containing stabilizers from the group of benzotriazoles and mercaptotetrazoles are also preferred. Examples of such stabilizers are 1-phenyl-5-mercaptotetrazole, 1-(4-hydroxyphenyl)-5-mercaptotetrazole, 1-(1-naphthyl)-5-mercaptotetrazole, 1-cyclohexyl-3-mercaptotetrazole, 1-(4-chlorophenyl)-5-mercaptotetrazole, 1-(3-capramidophenyl)-5-mercaptotetrazole, benzotriazole, 5-chlorobenzo-triazole, 5-bromobenzotriazole, 5-methylbenzotriazole, 5-nitrobenzotriazole, 5-benzoylaminobenzotriazole, 1-hydroxymethylbenzotriazole,and 6-cyanobenzotriazole.

In the invention, the use of alkanolamines of the current state of the art is either completely unnecessary or their quantity can be reduced to a small fraction. Thus, the process can be operated without noxious or harmful odor, and corrosion by amino compounds volatilizing from the developer is avoided.

The invention's contrast-enhancing compounds can be added to the emulsion at any stage of preparation. Due to their molecular structure, they can be both surface-active and interactive with ionic polymers. The nitrile groups confer hydrophilic properties on the compounds. However, the hydrocarbon groups present in the molecule are hydrophobic and limit diffusion. It is, therefore, possible to coordinate aqueous solubility, interfacial activity, and diffusion capability of the compounds for each end use by selecting the number of nitrile groups, the number and type of hydrocarbon groups, and optionally other hydrophilic groups, such as, for example, ethylene oxide groups.

It is further advantageous for the invention's compounds to decompose to photographically inactive products in the alkaline developer baths. Thus, the invention's compounds do not accumulate in the developer due to washing out like other known contrast-enhancing compounds incorporated into recording material. Therefore, they will not impair the stability of developer activity, even if their diffusion is only slightly limited (ballasted).

The invention can be used to produce black and white negative images having ultrahigh contrast, especially in reprography during the pre-press stage for black and white and multicolor printing. The invention is explained in more detail in the following example.

EXAMPLE 1

A cubic silver chlorobromide emulsion (80 mole percent chloride) having grains of 0.21 μm edge length was prepared by double jet precipitation. After soluble salts were removed by flocculation, total gelatin content was adjusted to 55 g per mole of silver, and the emulsion was chemically ripened with potassium thiotosylate, a thiosulfate, and a gold salt. The following were then added: potassium iodide (1.6 mmole/mole of Ag), phenyl-mercaptotetrazole, 5-nitroindazole, a polyethylene latex, a sensitizer for the green spectral range, two coating aids (Triton® X-102 and Triton® X-200, made by Rohm and Haas), 0.12 mmole of 1-pyridiumacetyl-2-(4-benzyloxy-phenyl)hydrazine bromide (Compound H-9) per mole of silver, and 0.10 mmole of the sodium salt of dichlorohydroxytriazine per g of gelatin. Camera films were prepared by coating the emulsion together with overcoatings containing gelatin, matte agent, surfactant (Triton® X-200) and additives shown in Table 1. The silver coating weight was 4.2 g/m$^2$, and the overcoating weight was 0.9 g of gelatin per square meter.

The following comparison compounds were used:

$(C_2H_5)_2N-CH_2-CHOH-CH_2OH$ V-1

V-2

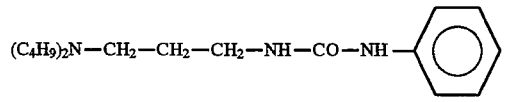

V-3

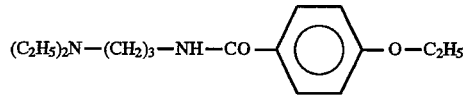

Test strips of the resulting recording materials were exposed with white light through an original consisting of a continuous tone wedge partially atop a contact screen. The strips were developed in a developing machine (Dürr Graphica) at 36° C., fixed, washed, and dried. The developing time was 28 seconds. A commercial fixing bath was used. The developer had the following composition:

| | g |
|---|---|
| Water | 500 |
| Sodium bisulfite | 50 |
| KOH | 27 |
| EDTA trisodium salt | 3.7 |
| Hydroquinone | 25 |
| Potassium bromide | 4 |
| Benzotriazole | 0.3 |
| Phenylmercaptotetrazole | 0.05 |
| 4-hydroxymethyl-4-methyl-1-phenyl pyrazolidinone | 1 |
| Boric acid | 3 |
| Sodium hydroxide | 24 |
| Diethylene glycol | 40 |
| Water to Make 1 Liter, pH 10.5 at 22° C. | |

The processed strips were evaluated according to the following criteria: minimum density (Dmin); maximum density (Dmax); sensitivity (S) as the density of the continuous tone wedge at the point of 50% tonal value in the halftone image; foot gradation (G1) between densities D=0.1 and 0.4 in the continuous tone image; main gradation (G2) between D=1.0 and 2.5; and visual evaluation of the dot quality (PQ) of the halftone dots. The value 10 indicates optimum dot sharpness, 4–5 is only conditionally useful and corresponds to the sharpness of a rapid access film without contrast enhancement, and 1–3 is useless. The results are summarized in Table 1.

TABLE 1

| | Additive | | | | | | | |
|---|---|---|---|---|---|---|---|---|
| Test | Compound | Quantity ($mg/m^2$) | Dmin | Dmax | S | G1 | G2 | PQ |
| 1 | — | | 0.04 | 5.2 | 1.20 | 4.0 | 9.0 | 5 |
| 2 | V1 | 40 | 0.04 | 5.2 | 1.24 | 4.2 | 8.9 | 5 |
| 3 | V2 | 40 | 0.04 | 5.2 | 1.24 | 5.5 | 12 | 5 |
| 4 | V3 | 40 | 0.04 | 5.2 | 1.22 | 4.4 | 9 | 5 |
| 5 | 8 | 20 | 0.04 | 5.2 | 1.40 | 9.2 | >25 | 9 |
| 6 | 8 | 30 | 0.04 | 5.2 | 1.41 | 9.1 | >25 | 9 |
| 7 | 3 | 40 | 0.04 | 5.2 | 1.35 | 6.9 | 18 | 8 |

What is claimed is:

1. A photosensitive silver halide recording material, for making ultrahigh contrast, black-and-white, negative images, the material having at least one photosensitive layer which includes a silver halide emulsion on at least one side of a support, the photosensitive layer containing at least one hydrazine compound, characterized in that the photosensitive layer contains at least one contrast-enhancing compound having in its molecule at least one tertiary amino group and at least one nitrile group.

2. A photosensitive silver halide recording material for making ultrahigh contrast, black-and-white, negative images, the material having at least one photosensitive layer which includes a silver halide emulsion on at least one side of a support, the photosensitive layer containing at least one hydrazine compound, characterized in that at least one other layer on the same side of the support as the photosensitive layer and in reactive relationship with the photosensitive layer contains at least one contrast-enhancing compound having in its molecule at least one tertiary amino group and at least one nitrile group.

3. The photosensitive silver halide recording materials, according to claim 1 or 2, characterized in that the contrast-enhancing compound falls under one of the General Formulas (A), (B), or (C)

$$RR^1N—X—(CN)_n \quad (A)$$

$$NC—X—NR^2—B—NR^2—X—CN \quad (B)$$

$$RR^1N—X—N(CH_2CN)_2 \quad (c)$$

wherein

R and $R^1$ are identical or different, each an optionally substituted alkyl group having 1 to 6 carbon atoms, or an optionally substituted benzyl group, or R and $R^1$ form a five to eight member ring together with the nitrogen atom and optionally another oxygen or nitrogen atom, $R^2$ is a saturated or unsaturated alkyl group or an aryl group, groups which can be further substituted, and also can be an alkyl group linked by its end away from the nitrogen to a carbon atom of Group B to form a ring, X is a divalent or trivalent linking group, B is a divalent linking group, and n is 1 or 2.

4. The photosensitive silver halide recording material according to any of claim 1 or 2, characterized in that the hydrazine compound has the General Formula (H)

$$B—Phenyl—NHNH—L—G \quad (H).$$

wherein B is a ballast group, G is an activating group, and L is CO or CO—CO.

5. The photosensitive silver halide recording material according to claim 1 or 2, characterized in that it contains the contrast-enhancing compound in an amount of 0.05 to 5 g per mole of silver.

6. The photosensitive silver halide recording material according to claim 1 or 2, characterized in that the silver halide in the emulsion comprises more than 80 percent by weight of cubic grains.

7. The photosensitive silver halide recording material, according to claim 1 or 2, characterized in that the silver halide in the emulsion has an average grain size of 0.15 to 0.30 μm.

8. The photosensitive silver halide recording material, according to claim 1 or 2, characterized in that the silver halide in the emulsion is monodispersed.

9. A process for making a black-and-white negative image having ultrahigh contrast, characterized in that a recording material according to claim 1 or 2 is subjected to the steps of exposing and developing in a developer having a pH between 9 and 11.

10. The process according to claim 9, characterized in that the developer contains more than 0.30 mole of sulfite per liter.

11. The photosensitive silver halide recording material, according to claim 2, characterized in that the hydrazine compound is present in the at least one other layer in reactive relationship with the photosensitive layer.

* * * * *